US006044738A

United States Patent [19]

Hawley et al.

[11] Patent Number: 6,044,738

[45] Date of Patent: Apr. 4, 2000

[54] METHOD FOR REMOVING WIRES FROM BALES OF COMPRESSIBLE MATERIAL

[75] Inventors: Mike Hawley, Beaconsfield, Canada; Stephen Hood; Stanley R. Merrill, both of Hoquiam, Wash.

[73] Assignee: Lamb-Grays Harbor Co., Hoquim, Wash.

[21] Appl. No.: 08/940,804

[22] Filed: Sep. 30, 1997

Related U.S. Application Data

[62] Division of application No. 08/815,995, Mar. 10, 1997, Pat. No. 5,718,157, which is a continuation of application No. 08/458,498, Jun. 2, 1995, abandoned.

[51] Int. Cl.[7] ..... B26D 7/32

[52] U.S. Cl. ..... 83/23; 83/155; 83/923; 83/909; 29/426.4; 29/564.3; 241/605; 242/470

[58] Field of Search ..... 83/23, 27, 861, 83/84, 102, 155, 646, 647, 697, 923, 909, 401, 156, 157, 167, 155.1, 416, 437.1, 548, 563, 624; 29/564.3, 426.4; 241/605, 270, 271, 272; 242/470

[56] References Cited

U.S. PATENT DOCUMENTS

| | | | |
|---|---|---|---|
| 2,820,282 | 1/1958 | Schneider, Jr. | 83/909 X |
| 3,513,522 | 5/1970 | Thomson | 29/200 |
| 4,163,524 | 8/1979 | Lundahl et al. | 241/605 X |
| 4,348,801 | 9/1982 | Dumont et al. | 83/909 X |
| 4,553,312 | 11/1985 | Mitzel et al. | 83/909 X |
| 4,718,157 | 1/1988 | Keyzers et al. | 83/909 X |
| 4,773,148 | 9/1988 | Ohya et al. | 29/564.3 X |
| 4,831,713 | 5/1989 | Hodén et al. | 29/564.3 |
| 4,835,836 | 6/1989 | Van Uitert | 83/923 X |
| 4,850,087 | 7/1989 | Gronau | 29/33 R |
| 4,924,918 | 5/1990 | Lin et al. | 140/102 |
| 4,929,141 | 5/1990 | Keesey et al. | 414/412 |
| 4,995,784 | 2/1991 | Boisseau | 83/909 X |
| 5,052,098 | 10/1991 | Thumm | 29/564.003 |
| 5,105,527 | 4/1992 | Miyata | 83/909 X |
| 5,131,135 | 7/1992 | Gronau | 29/564.3 |
| 5,199,841 | 4/1993 | Von-Gehlen | 83/909 X |
| 5,211,525 | 5/1993 | Moltrasio | 83/909 X |
| 5,216,797 | 6/1993 | Hall | 29/426.4 |
| 5,228,628 | 7/1993 | Temburg et al. | 241/101.4 |
| 5,242,121 | 9/1993 | Neier | 241/605 X |
| 5,249,341 | 10/1993 | Gronau | 29/33 R |
| 5,303,460 | 4/1994 | Neilsen et al. | 29/564.3 |
| 5,371,938 | 12/1994 | Martin | 83/923 X |
| 5,375,316 | 12/1994 | Carlson et al. | 29/564.3 |
| 5,425,219 | 6/1995 | Tanaka et al. | 83/909 X |
| 5,718,157 | 2/1998 | Hawley et al. | 83/155 |

FOREIGN PATENT DOCUMENTS

| | | |
|---|---|---|
| 281942 | 9/1988 | European Pat. Off. . |
| 393325 | 10/1990 | European Pat. Off. . |
| 2816912B1 | 10/1979 | Germany . |
| 2821336B1 | 10/1979 | Germany . |
| 9115485 | 2/1992 | Germany . |
| WO 93/01911 | 2/1993 | WIPO . |

*Primary Examiner*—Rinaldi I. Rada
*Assistant Examiner*—Boyer Ashley
*Attorney, Agent, or Firm*—Seed Intellectual Property Law Group PLLC

[57] ABSTRACT

A method for removing wires from a bale of waste cardboard and paper material that is compacted in vertical layers with wires running at right angles to the layers and in vertical planes. A cutting blade is moved downwardly through the wires and bale of waste material to separate a forward portion of the bale of waste material from the remainder of the bale of waste material and from the cut wires. The cut wires are gathered ahead of and beneath the bale of waste material into a bundle with opposed pairs of hook blades moved toward one another to interdigitate in overlapping relation to grasp the bundle of wires in a wire-receiving recess. A rotating fork is inserted into the wire receiving recess to coil the cut wires and pull them free from the bale of waste material as the bale of waste material is moved forward. The recess is cleared by withdrawing the fork from the coil and pushing the coiled wire with a pushing finger clear of the recess.

11 Claims, 6 Drawing Sheets

METHOD FOR REMOVING WIRES FROM BALES OF COMPRESSIBLE MATERIAL

CROSS-REFERENCE TO RELATED APPLICATION

This application is a divisional of an allowed U.S. patent application Ser. No. 08/815,995, now U.S. Pat. No. 5,718,157 filed Mar. 10, 1997, which was a file wrapper continuation of U.S. patent application Ser. No. 08/458,498, filed Jun. 2, 1995, abandoned.

TECHNICAL FIELD

This invention relates to apparatus and methods for removing the wires around bales of compressible material, particularly compacted waste cardboard and paper to be used for recycling.

BACKGROUND OF THE INVENTION

Bales of waste cardboard, or other paper waste products, are often formed by discarding the waste material into a compactor bin. At various time periods the material is compacted into a vertical layer. This process is repeated until the bin is full and the compacted bale is to be removed from the bin. At this time wires are tightly wrapped around the bale so that the bale remains in a compressed condition for subsequent shipment.

The wires that hold the waste material bale together are under considerable tension since the waste material after compaction has considerable resiliency trying to expand against the wires. Often the wires cut through the waste material so that the wires adhere tightly to the bale creating considerable friction between the wires and the bale even after the wires are cut. This friction or adhesion between the wires and the bale creates difficulties when the wires are removed under a mechanical or automated wiring removing system. If the cut wires are simply pulled along the surfaces of the bale to a central gathering point or pulling location, the adhesion between the wires and the bale is often so great that the wires will break rather than pull free of the bale. This condition makes the removal of the wires from the bale using automated equipment less cost-effective.

SUMMARY OF THE INVENTION

This invention is directed to a unique apparatus and method for removing the wires from a compressed bale of waste material, such as paper and cardboard waste, by separating a portion of the bale from the remainder of the bale during the cutting of the wires so that the separated portion of the bale falls free of the remainder of the bale and disconnects from the wires. This leaves less surface area of the bale in contact with the wires reducing the area for adhesion between the wires and the bale. As a result, the wires will more consistently be pulled free of the remainder of the bale with significantly less chance of breakage of the wire.

In one form of the invention the bales are cut and a forward portion of the bale is separated by using a reciprocating saw blade. In another form the blade is a rotary saw blade. In the preferred form the cut wires are gathered into a bundle by a pair of gathering hooks. If waste material is still clinging to the wires and impeding the formation of the bundle of wires, the hooks can be repeatedly reciprocated until the waste material is cleared from the bundle of wires. The wires are preferably gathered in a rotating fork device and formed into a coil which is subsequently discharged to a collection bin.

The method preferably simultaneously cuts through the wires and separates a forward portion of the bale from the remainder of the bale and free of the baling wires. The wires are then pulled from the remainder of the bale to a central gathering location where they are removed.

The advantages of the method and apparatus result in having less wire breakage and more consistent removing of the wires from the bale.

DETAILED DESCRIPTION OF THE INVENTION

Figures 1, 2:
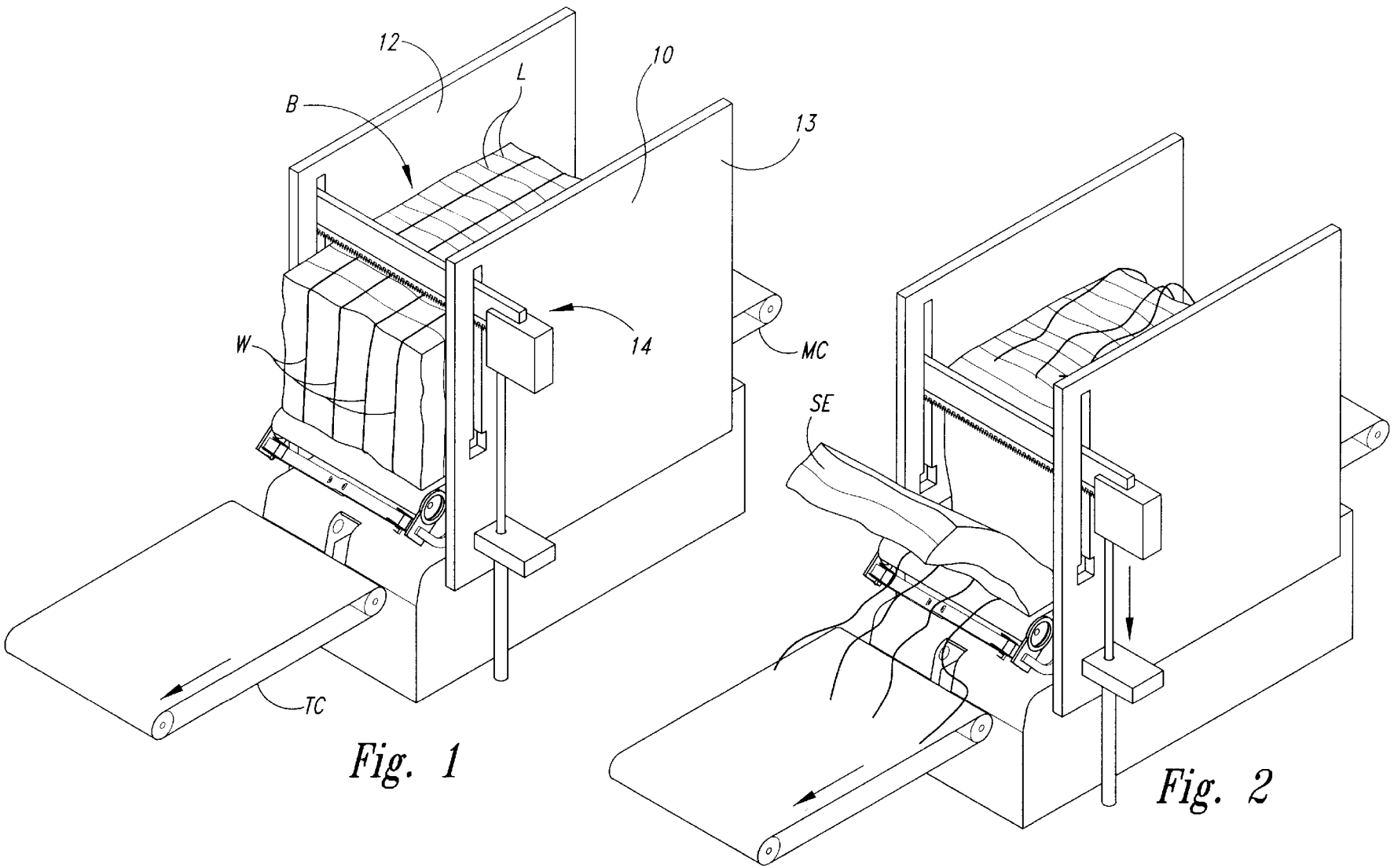
FIG. 1 is an isometric illustrating a compressed bale with wires holding the bale tightly compressed at a wire removing station.
FIG. 2 illustrates the wires being cut and the forward portion of the bale being separated from the bale.
Figures 3, 5:
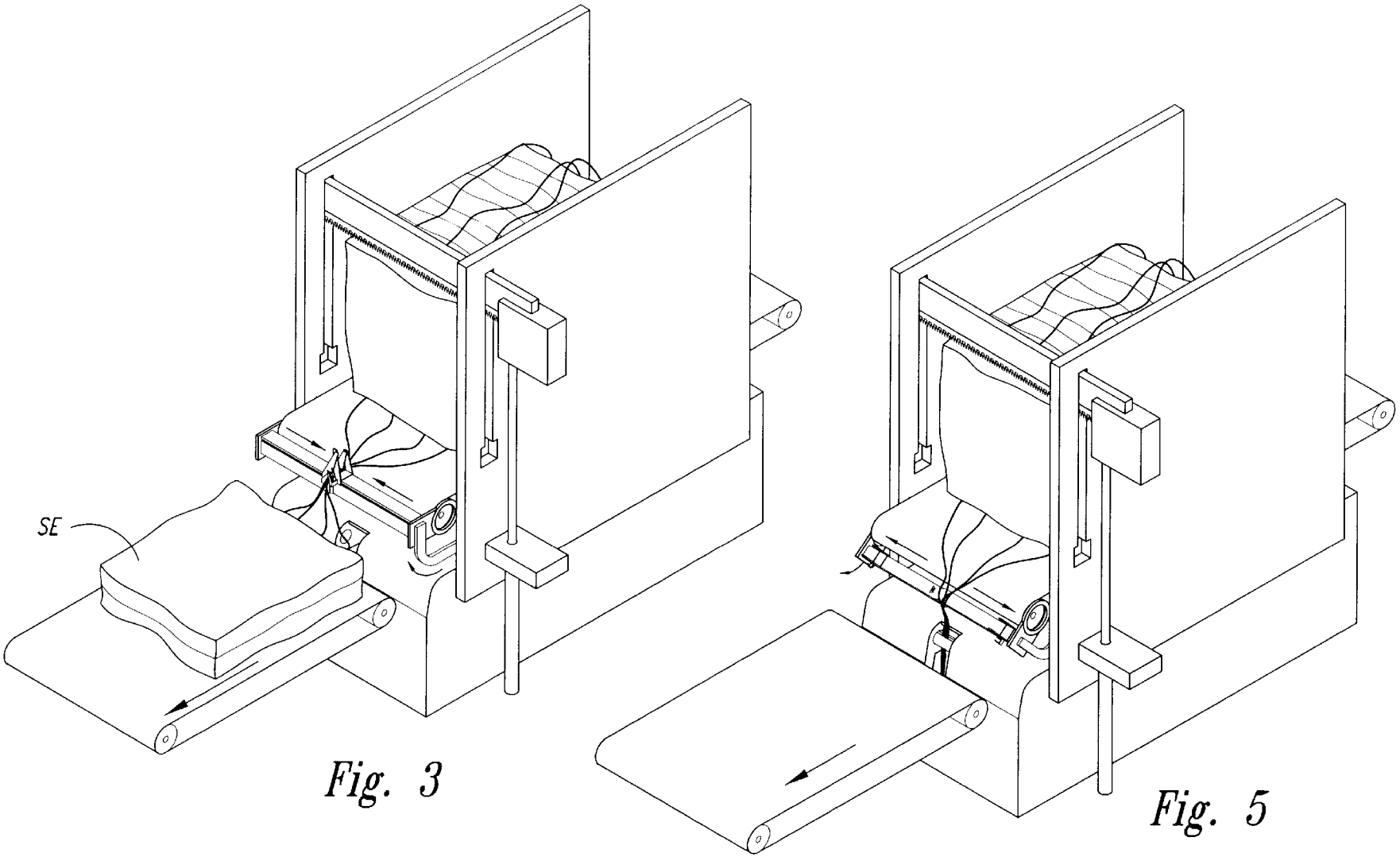
FIG. 3 illustrates the gathering of the cut wires.
FIG. 5 illustrates the wires being gathered by the coiling fork.

As best illustrated in FIG. 1, a wire removing station is provided with a main conveyor MC and a pair of spaced support stands or blade support 12 and 13. A bale B formed of highly compressed waste material is formed into a plurality of generally vertical layers L and held in place by a plurality of wires W wrapped around the bale at right angles to the layers. The bale is delivered to the wire removing stand on the conveyor MC and positioned beneath a wire and bale cutting mechanism 14.

Figure 11:
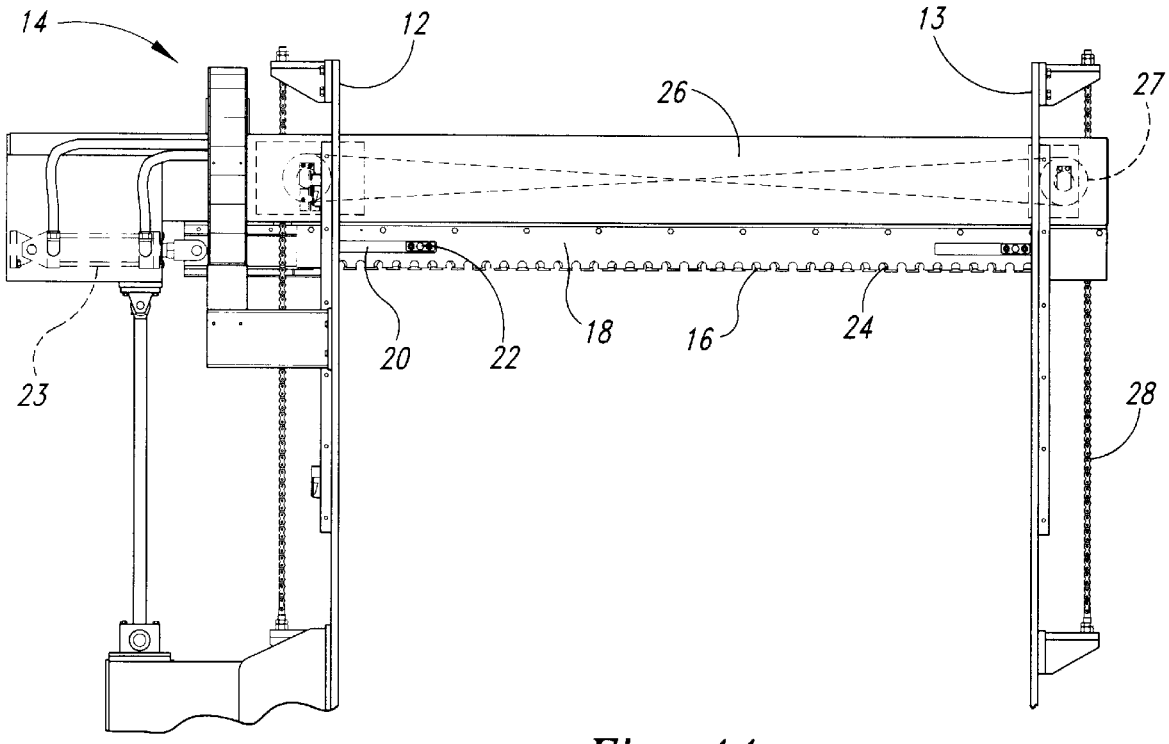
FIG. 11 illustrates the mechanism for reciprocating the wire cutting and bale sawing apparatus.

As best shown in FIGS. 2 and 11, the wire and bale cutting mechanism 14 includes a fixed blade 16 and a moveable blade 18. The movable blade has a pair of slots 20 which receive stops 22 fixed to the rear fixed blade. A hydraulic ram 23 reciprocates the movable blade relative to the fixed blade so that the teeth 24 on the two blades provide a sawing action. As the blades are then lowered, the sawing action not only cuts through the wires W but also cuts a portion or end SE of the layers of the bale free from the remainder of the bale. The forward portion falls free of the bale onto a take-away conveyor TC and is thus cleared from the wires which remain hanging over the end of the discharge end of the main conveyor MC. As best shown in FIG. 11, the blades 16 and 18 are mounted on a crossbeam 26 which is movable up and down vertically by a pair of sprockets 27 which engage fixed vertical chains 28. The sprockets are powered in a conventional manner such that they rotate simultaneously and in the same direction to move the beam, and thus the blades, vertically up and down to cut through the wires and the bale and then be retracted for removal from the remainder of the bale. The blades normally are moved down into the bale beyond the depth of the wires in the bale to the extent necessary to free the forward separated end of the bale. The blades may also be drawn down further than normal if the material of the bale is such that the forward end is difficult to separate.

Figure 12:
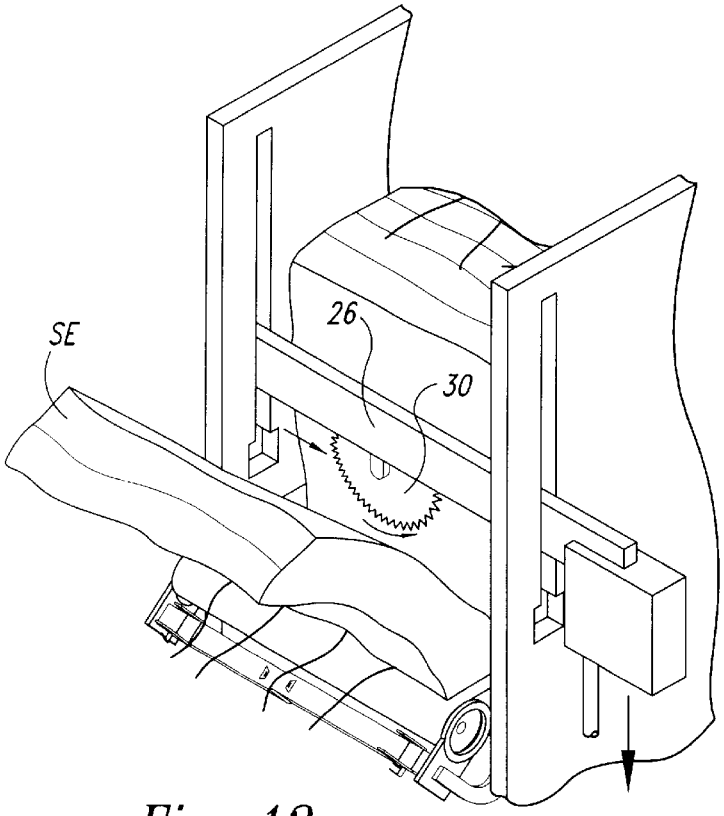
FIG. 12 is a schematic illustration showing an alternative form of wire cutting and sawing apparatus.

FIG. 12 illustrates an alternative form of cutter in which a rotary cutting blade 30 is suitably mounted on the crossbeam 26 and can be rotated and simultaneously moved across the bale to cut the wires and cut a forward portion of the bale free of the bale.

Figure 4A:
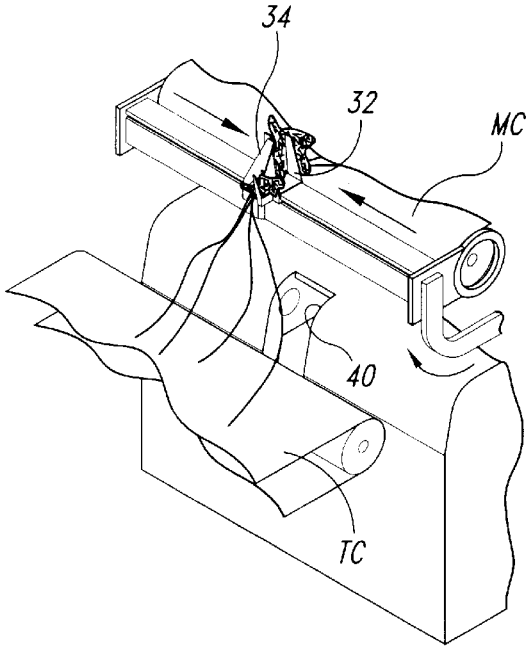
FIGS. 4A and 4B illustrate the gathering technique which uses the hooks to free the waste material that may be clinging to the wires.
Figure 4B:
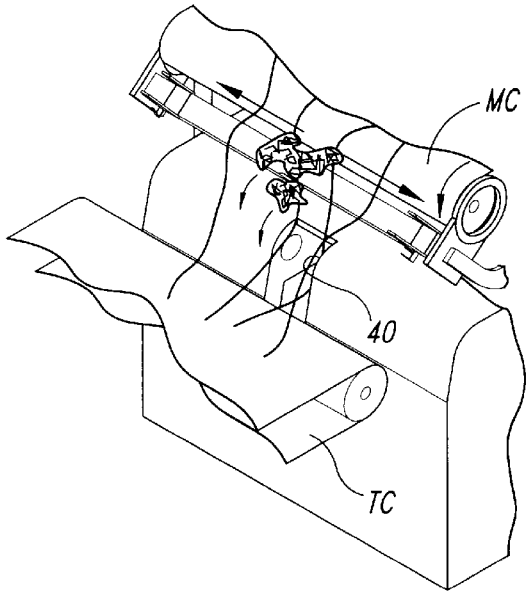

As best shown in FIGS. 4A–4D, 5 and 6, the wires which have been cut at the top of the bale fall free over the discharge end of the main conveyor MC with the collapse of the separated end SE. The wires lay over the end of the conveyor and are generally spaced from one another. At this point a right-hand pair of gathering hooks 32 and a left-hand pair of gathering hooks or hooking plates 34 are provided to reciprocate toward one another to gather the cut wires into the intersection between the pairs of hooks or hooking plates. The hooks are reciprocated by separate cylinders 35 and occasionally will gather residual waste material, that is still adhering to the wires, as shown in FIG. 4A. It is desirable to clear this waste material from the wires before the wires can be coiled and removed from the bale. For this purpose, the gathering hooks can be reciprocated away from one another and again toward one another repeatedly until the waste material falls free of the wires. This usually happens after one or two extra reciprocating movements of the gathering hooks.

Figure 4C:
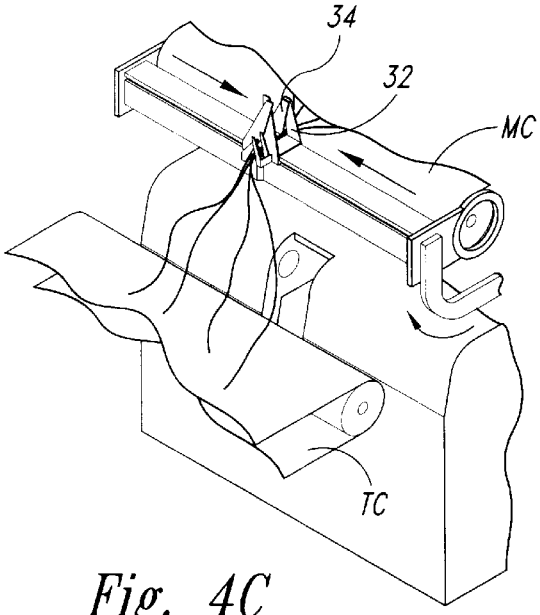
FIG. 4C illustrates gathering the wires with the waste material free of the wires.
Figure 4D:
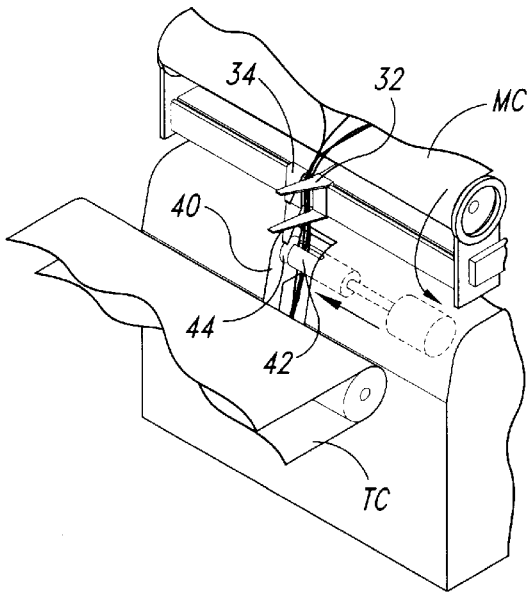
FIG. 4D illustrates gathering the wires and placing them into a position where a coiling fork can grasp the wires.
Figure 6:
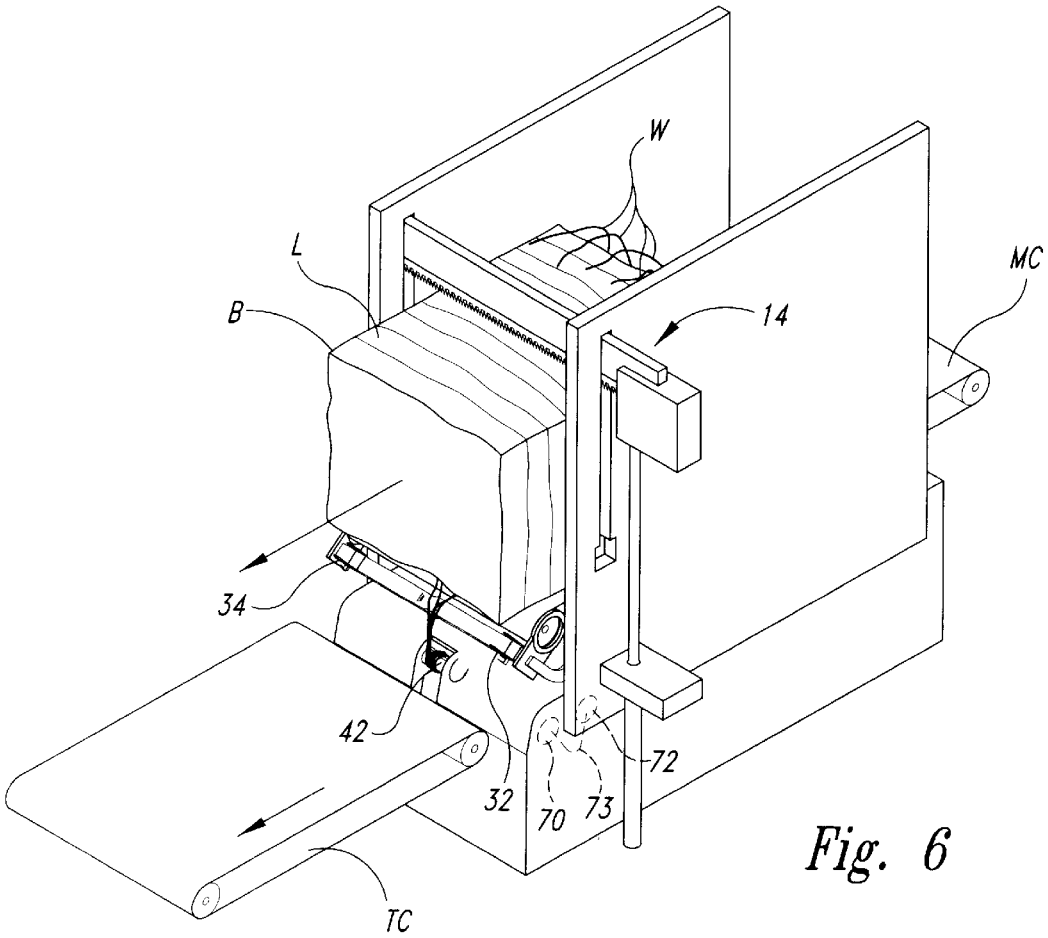
FIG. 6 illustrates the wires being coiled and pulled from the bale with the remainder of the bale being advanced along the conveyor to help in the removal of the wires from the bale.
Figure 7:
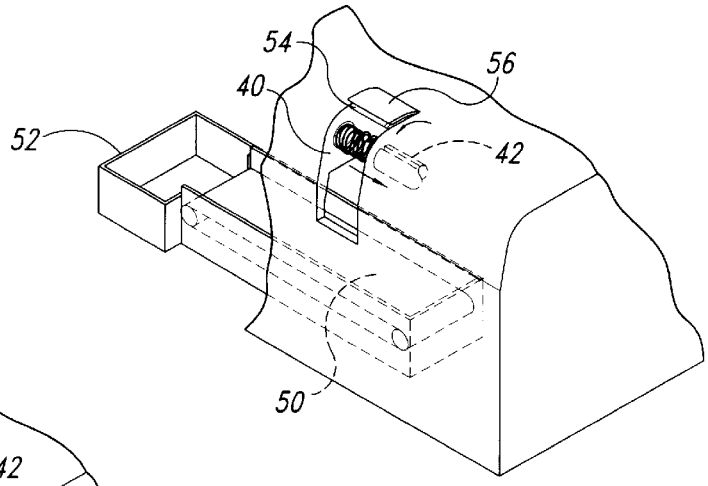
FIGS. 7 and 8 illustrate removal of the coiled wire from the apparatus.

After the waste material, if any, is cleared from the wires, the gathering hooks gather the wires into a bundle as shown in FIG. 4C. At this point the gathering hooks are rotated further by the ram 38 (FIG. 9) drawing the bundle of wires downwardly into a wire gathering or wire receiving recess 40. Mounted within the wire gathering recess 40 is a rotatable fork 42 that is received in an opening 44, (FIG. 8) at the opposite side of the wire gathering recess so that the fork extends the full distance across the recess. The slot in the fork is vertically positioned so that it slides over the gathered bundle of wires as shown in FIG. 4D. The gathering hooks are then moved clear of the recess and to the open position such as in FIG. 5. A conventional motor 70 then rotates the fork in a conventional manner. The fork gathers the wires into a coil pulling the wires free from the remainder of the bundle. Since the forward part of the wires are no longer attached to any portion of the bundle, the only friction between the wires and the bale is the friction at the remainder of the bale. This is a considerably smaller area of contact between wires and the bale such that the wires will normally not have sufficient adhesion to the bale to resist being pulled from the bale to the extent that they would break. Advancing the remainder of the bale while the wire is coiled, as described below, also helps to free the wire from the remainder of the bale. Thus, the wires are pulled free and wrapped into a tight coil as shown in FIG. 6.

Figure 8:
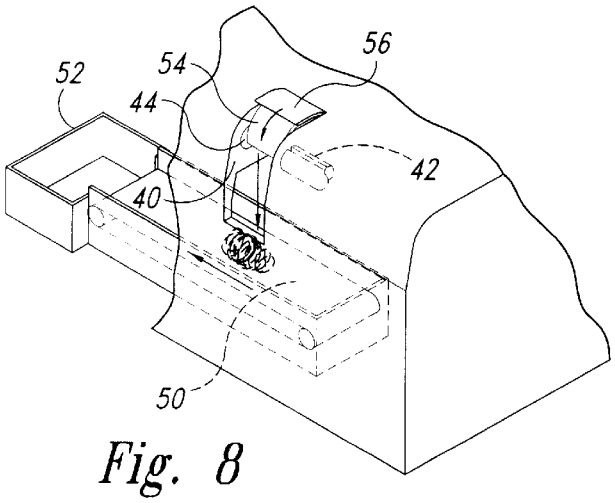
Figure 9:
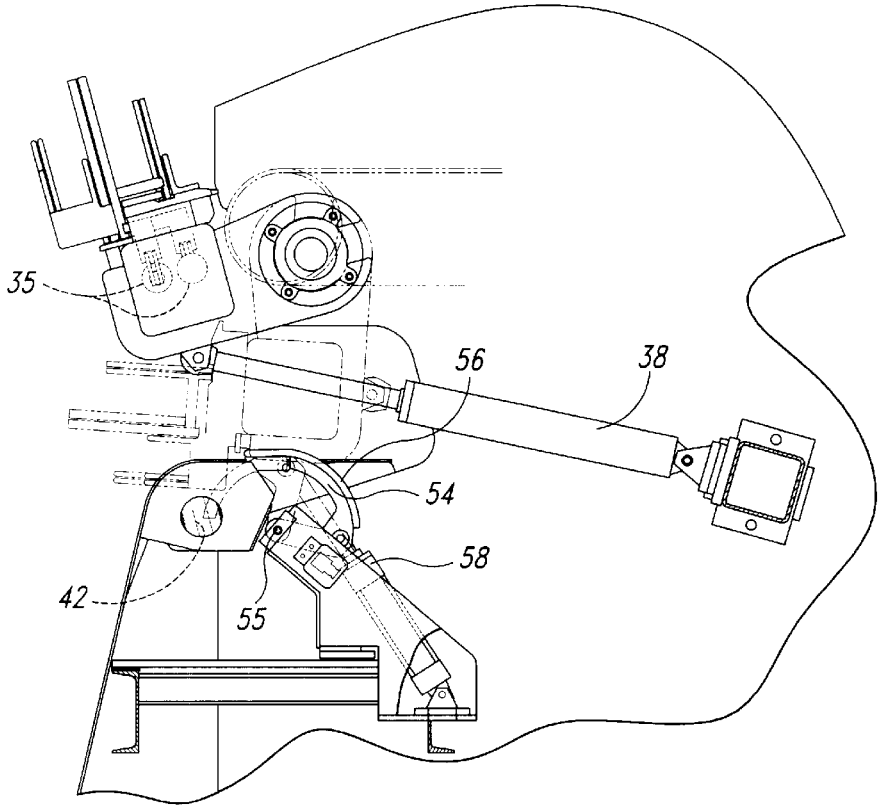
FIG. 9 is a side view showing more details of the mechanisms for moving the wire gathering hooks and moving a finger for clearing the coiled wire from the machine.
Figure 10:
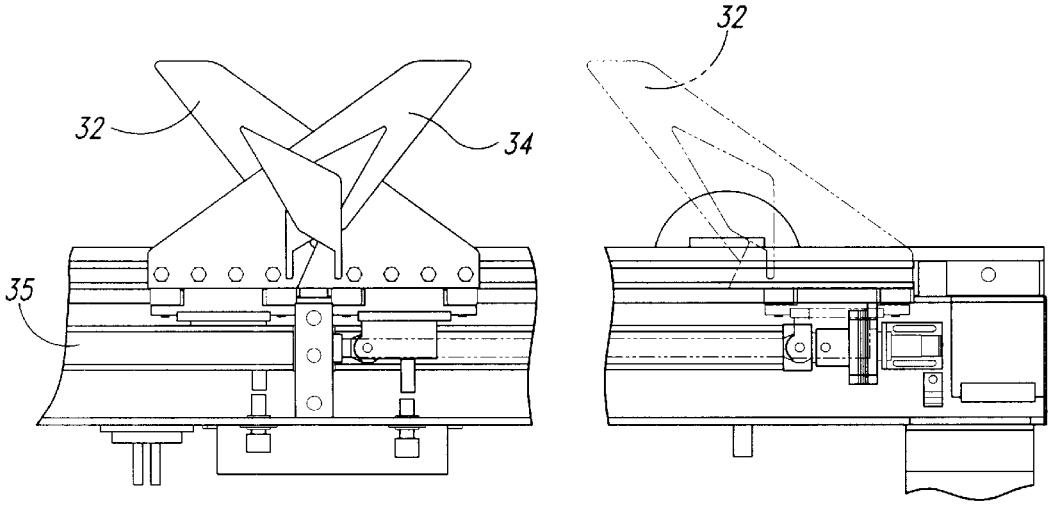
FIG. 10 illustrates the mechanism for reciprocating the wire gathering hooks.

To help clear the coil from the wire gathering recess a pushing or clearing finger 54 pivoted as at 55 is moved along a guide 56 by the motion of a ram 58 such that the finger 54 is moved from the retracted position shown in FIG. 9 to an extended position shown in FIG. 8 where it sweeps past the opening 44 pushing the coil out of the wire gathering recess on to a conveyor 50 where it can be removed. The conveyor moves the coil to a salvage box 52.

The method and operation of the apparatus is best described by moving a compressed wired bale of layered waste material to the wire removing station 10. At that station lowering the wire cutting and bale cutting blades through the wires down deep enough into the bale such that a forward end of the bale is separated and falls onto a take-away conveyor. This leaves the wires at the forward end of the bundle free at which time they are gathered into a bundle by the gathering hooks which pulls the wires down into a wire gathering recess. The bundled wires are then coiled by the rotating fork received in the wire-receiving recess with the wires being pulled free from the remainder of the bale. The coiled wires are then removed from the wire-receiving recess and the method is ready to be repeated. During the coiling of the wire with the wire coiling fork the main conveyor MC is advanced by conventional conveyor motor 72 operated simultaneously with motor 70 by any conventional hydraulic or electricsl circuitry 73 as shown in FIG. 6 so that the remainder of the bale begins to drop off the forward end of the main conveyor. This further helps to release the wires from their attachment to the remainder of the bale.

While the embodiments of the invention have been illustrated and described, it should be understood that further variations will be apparent to those skilled in the art. For example, the wire could be pulled by mechanisms other than a rotating fork. The cutting blade could be a sharp guillotine type blade. Accordingly, the invention is not to be limited to the specific embodiments illustrated in the drawing.

What is claimed is:

1. A method of removing wires from a compacted layered bale of waste material having vertical layers and a forward face across an entire width of the bale bound tightly together with wires running around the bale of waste material perpendicular to the layers and in vertical planes, the method comprising the steps of:

moving said bale of waste material along a path to a cutting station;

cutting through the wires on the bale of waste material and into the bale of waste material downwardly across substantially the entire width of the bale of waste material and a distance to separate a forward portion of the bale of waste material and wires leaving a remainder of the bale of waste material and wires separated from the forward portion of the wires, the forward portion including substantially the entire forward face of the bale, the cut wires having cut ends, the cut ends being relatively free of waste material;

removing the wires from the remainder of the bale of waste material removing the separated forward portion of the bale of waste material away from the cutting station and gathering the wires.

2. The method of claim 1, said step of cutting the wires and separating the forward portion of the bale of waste material, including sawing through the wires and into the bale of waste material with a reciprocating saw-toothed cutter.

3. The method of claim 1, said step of cutting the wires including moving a sharp blade downwardly through the wires and into the bale of waste material to separate the forward portion of the bale of waste material.

4. The method of claim 1, said step of cutting the wires including passing a rotary saw blade across the bale of waste material cutting the wires and separating the forward portion of the bale of waste material from the remainder of the bale of waste material.

5. The method of claim 1, said step of cutting the wires and bale of waste material including moving occasionally downwardly into the bale of waste material an exaggerated amount beyond normal to separate a particularly difficult portion of the bale of waste material.

6. The method of claim 1, including the step of gathering the cut wires ahead of the bale of waste material into a compact bundle; said step of gathering the cut wires including hooking all of the cut wires from two opposite directions and moving them toward one another into said bundle.

7. The method of claim 6, said step of removing the wires including coiling the gathered and bundled of cut wires and moving the coiled wire free of the cutting station to make clearance for coiling wires from the next bale of waste material.

8. The method of claim 7, including the step of moving the bale of waste material forward after separating the forward portion of the bale of waste material while removing the wires so that the wires are removed as the bale of waste material advances rather than the wires being pulled across a bottom of a stationary bale of waste material.

9. The method of removing wires from a compacted bale of material having a forward end, the method comprising the steps of:

moving said bale of material along a path to a cutting station;

cutting through the wires on the bale of material, the cut wires having cut ends;

gathering the cut ends of the wires at a gathering location below and ahead of the bale of material into a compact bundle; and removing the cut wires from the bale of material; said step of removing the cut wires including moving the bale of material forward while removing the wires at the gathering location so that the wires are removed as the bale of material advances to the gathering location rather than the wires being pulled across the bottom of a bale of material.

10. The method of claim 9 further including the step of separating the forward end of the bale of material from the bale of material as the bale of material advances and continuing to remove portions of the remainder of the bale of material as the wires are being removed so that more of the bale of material continues to be separated from the remainder of the bale of material left on a main conveyor to reduce an amount of the bale of material in contact with the wires.

11. The method of removing wires from a compacted layered bale of waste material having vertical layers bound tightly together with wires running around the bale of waste material perpendicular to the layers and in vertical planes, the method comprising the steps of:

moving said bale of waste material along a path to a cutting station;

cutting through the wires on the bale of waste material and into the bale of waste material a distance to separate a forward portion of the bale of waste material leaving a remainder of the bale of waste material separated from the forward portion of the bale of waste material and the forward portion being separated from the cut wires, the cut wires having cut ends, the cut ends being relatively free of waste material;

gathering the cut wires ahead of the bale of waste material into a compact bundle;

removing the wires from the remainder of the bale of waste material;

said step of gathering the cut wires including hooking all of the cut wires from two opposite directions and moving them toward one another into said bundle; and wherein if any waste material from the separated forward portion of the bale of waste material is attached to the wires, said step of gathering the cut wires including repeatedly moving the cut wires into said bundle, releasing the cut wires and re-gathering the cut wires until the waste material from the separated forward portion of the bale of waste material is dislodged from the cut wires and then coiling the gathered wires.

* * * * *

UNITED STATES PATENT AND TRADEMARK OFFICE

CERTIFICATE OF CORRECTION

PATENT NO : 6,044,738
DATED : Apr. 4, 2000
INVENTOR(S) : Mike Hawley, Stephen Hood, Stanley R. Merrill It is certified that errors appear in the above-identified patent and that said Letters Patent are hereby corrected as shown below:

Claim 1, column 4, line 55, "waste material" should read --waste material; and--.
Claim 7, column 5, line 17, "bundled of cut wires" should read --bundled cut wires--.

Signed and Sealed this

First Day of May, 2001

*Attest:*

Nicholas P. Godici

NICHOLAS P. GODICI

*Attesting Officer*

*Acting Director of the United States Patent and Trademark Office*